310-322 SR
10/4/77 OR 4,052,627

United States Patent [19] [11] 4,052,627
Hayakawa et al. [45] Oct. 4, 1977

[54] ULTRASONIC CERAMIC MICROPHONE

[75] Inventors: Daishiro Hayakawa, Neyagawa; Kenroku Tani, Katano, both of Japan

[73] Assignee: Matsushita Electric Industrial Co., Ltd., Osaka, Japan

[21] Appl. No.: 674,239

[22] Filed: Apr. 6, 1976

[30] Foreign Application Priority Data

Apr. 11, 1975 Japan ..... 50-44559

[51] Int. Cl.[2] ..... H04R 17/02; H04R 17/10
[52] U.S. Cl. ..... 310/322; 310/358
[58] Field of Search ..... 179/110 A; 310/8.5, 310/8.6, 8.2

*Primary Examiner*—George G. Stellar
*Attorney, Agent, or Firm*—Stevens, Davis, Miller & Mosher

[57] ABSTRACT

An ultrasonic ceramic microphone having a wide operating frequency range, including piezoelectric ceramic plates disposed on upper and lower surfaces of a metal plate, wherein the ultrasonic ceramic microphone is operated near two or three adjacent resonance frequencies and in a frequency band covering those resonance frequencies, of a fundamental wave and respective higher order harmonics of the deflection vibration of a transducer comprising the metal plate and the pair of piezoelectric ceramic plates.

4 Claims, 20 Drawing Figures

FIG. 15

| AL PLATE THICKNESS / CERAMIC PLATE / FREQUENCY (kHz) | 0.01 cm t | | | |
|---|---|---|---|---|
| | 0.6cm φ | | 0.82 cm φ | |
| | 0.026 cmt | 0.03cmt | 0.02 cmt | 0.03cmt |
| 10 | $10.0 \times 10^{-3}$ $(cm^{-1})$ | $9.0 \times 10^{-3}$ $(cm^{-1})$ | $7.3 \times 10^{-3}$ $(cm^{-1})$ | $8.3 \times 10^{-3}$ $(cm^{-1})$ |
| 20 | 15.4 | 15.1 | 12.3 | 12.1 |
| 30 | 19.3 | 19.8 | 16.5 | 15.1 |
| 40 | 23.0 | 23.5 | 23.7 | 17.0 |
| 50 | 26.9 | 26.9 | 31.9 | 22.0 |

ULTRASONIC CERAMIC MICROPHONE

The present invention relates to an ultrasonic ceramic microphone having a wide operating frequency range.

An ultrasonic ceramic microphone (hereinafter referred to as a microphone) using an electro-acoustic transducer (hereinafter referred to as a transducer) generally comprises, as shown in FIGS. 1(*a*) and 1(*b*) a metal plate 1 sandwiched by piezoelectric ceramic plates 2 and 3, and leads 4 and 5 connected to the piezoelectric ceramic plates 2 and 3, respectively to complete a transducer 6, which is, in turn, housed in a casing 8 having an opening 7 on one side as shown in FIGS. 2(*a*) and 2(*b*). The piezoelectric ceramic plates 2 and 3 are provided with electrodes on upper and lower surfaces thereof, and the polarizations of the piezoelectric ceramic plates 2 and 3 are in opposite sense to each other. A protective net 9, a terminal board 10, a metal base 11, a resilient bond 12 and terminal pins 13 and 14 are provided. FIG. 3 shows the admittance-frequency characteristic of the transducer 6, and FIG. 4 shows the receiving sensitivity-frequency characteristic thereof. Where a microphone 15 thus constructed is used for reception, if the frequency of an incoming sound wave coincides with the resonance frequency of the transducer 6, a voltage at that frequency appears across the electrodes of the transducer 6. This represents the receiving sensitivity. On the other hand, if an electric signal of the frequency equal to the resonance frequency of the transducer 6 is applied across the electrodes, the transducer 6 mechanically vibrates to produce a sound wave at that frequency. This constitutes a transmitting sound wave. This is the principle of operation of the microphone 15 when it is used for transmission. Such a type of microphone 15 has been widely used in a remote control device for a television receiver set, air conditioning apparatus, electric fan or automatic door of a garage, a sensor for a burglar-proof system, and a sensor for a proximity switch or range finder. Recently, as the number of functions of the television receiver set has increased, more frequencies have been used and hence it has been desired to broaden the operating frequency range of the microphone 15. However, the prior art microphone 15 could not satisfactorily comply with such wishes. Accordingly, in order to overcome the above drawback and provide a wide operating range microphone, various approaches have been tried. In one method, for example, a metal plate was divided into a plurality of segments to present several resonance frequencies. This method, however, is apt to produce spurious signals, and also has a drawback in that the sharpness of the respective segments is so high that little sensitivity is shown in the region between the resonance frequencies of the respective segments. This is illustrated in FIGS. 5(*a*) and (*b*). In FIG. 5(*b*), curve 16 shows a characteristic of the prior art microphone, and curve 17 shows a characteristic of a wide band microphone. In another method, the antinode of the vibration is tightened by a resilient material to lower the sharpness for damping the sensitivity at the peak point in order to attain a wide band characteristic. In this case, however, the reduction of sensitivity is substantial and the band can be broadened only by several kHz compared with the prior art system. This is illustrated in FIGS. 6(*a*) and (*b*). In FIG. 6(*b*), curve 18 shows a characteristic of a wide band microphone constructed in the above manner.

It is, therefore, an object of the present invention to provide a microphone which overcomes the disadvantages encountered in the prior art systems and is capable of broadening the band more than ten kHz compared with the prior system, and yet is easy to manufacture and very useful in industrial application.

The above and other objects, features and advantages of the invention will become more apparent from the following detailed description of the preferred embodiment of the invention when taken in conjunction with the accompanying drawings, in which;

FIGS. 1(*a*) and (*b*) show the construction of a commonly used electro-accoustic transducer, FIGS. 2(*a*) and (*b*) show the construction of an ultrasonic ceramic microphone using the electro-accoustic transducer of FIGS. 1(*a*) and (*b*).

Figure 5:
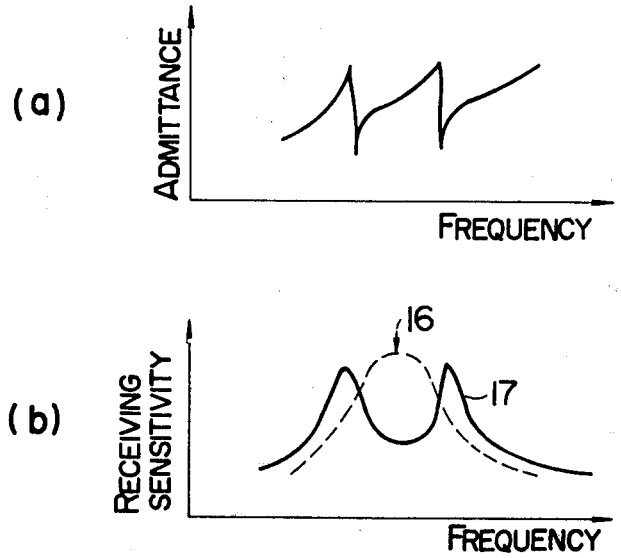
FIG. 5 PRIOR ART
Figure 6:
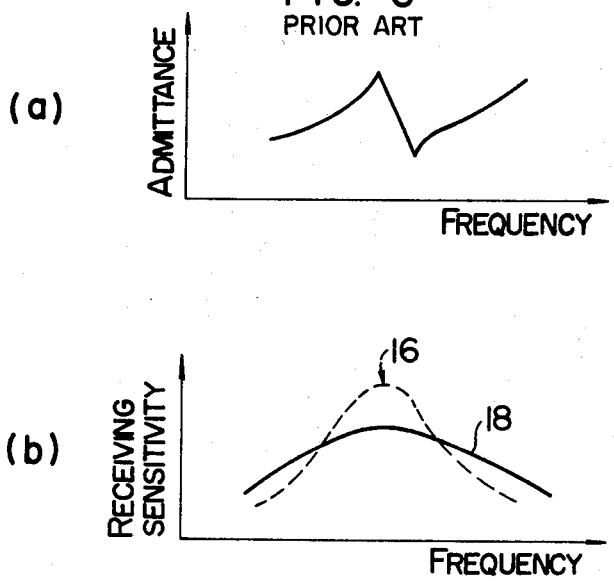
FIG. 6 PRIOR ART
Figure 7:
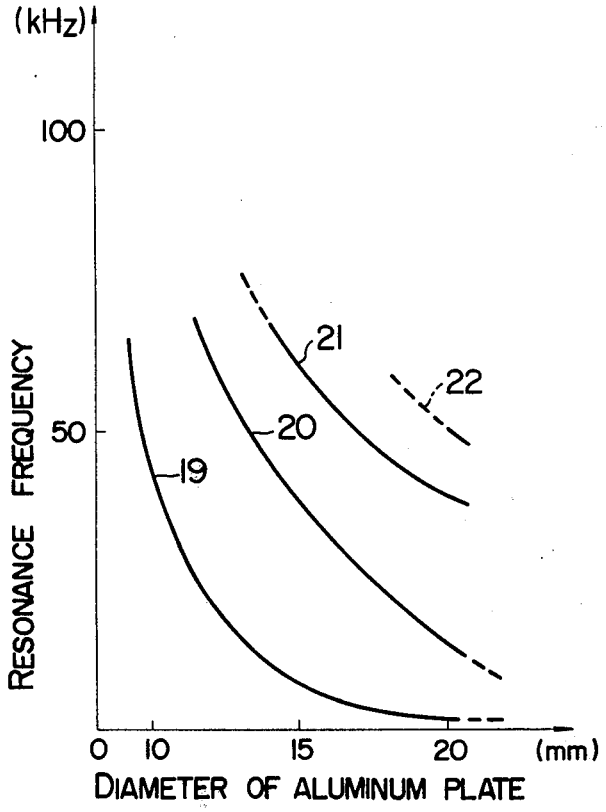

FIGS. 5(*a*) and (*b*) show the admittance characteristic and the receiving sensitivity characteristic of a prior art wide band microphone, FIGS. 6(*a*) and (*b*) show the admittance characteristic and the receiving sensitivity characteristic of another prior art wide band microphone, FIG. 7 shows the fundamental wave and first, second and third order harmonics with respect to the diameter of an aluminum plate having a thickness of 0.1 mm, with piezoelectric ceramic plates of 8.2 mm in diameter and 0.26 in thickness being used.

Figure 8:
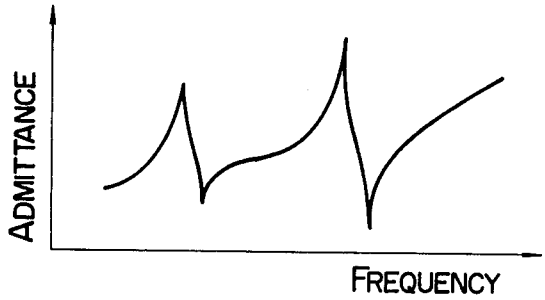

FIG. 8 shows an admittance characteristic in accordance with the present invention.

Figure 9:
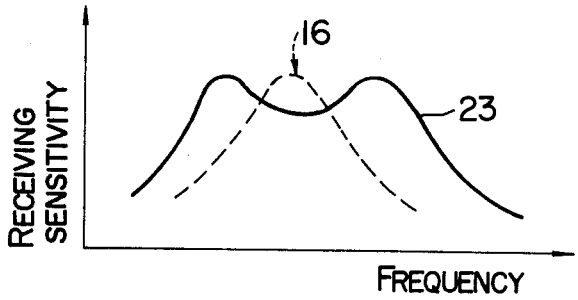

FIG. 9 shows the receiving sensitivity characteristic of a microphone of the present invention.

Figure 10:
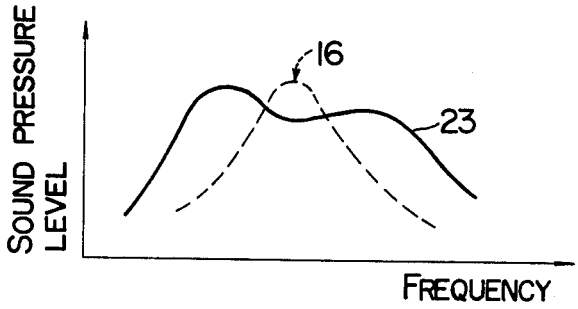

FIG. 10 shows the sound pressure level characteristic of a microphone of the present invention.

FIGS. 11 to 14 show the relationship between the diameters of aluminum plates and the resonance frequencies for various thickness and diameters of piezoelectric ceramic plates.

FIG. 15 summerizes FIGS. 11 to 14 showing the relation of $t/(R/2)^2$ cm$^{-1}$ between the diameter R and the thickness $t$ of the aluminum plate.

Figure 16:
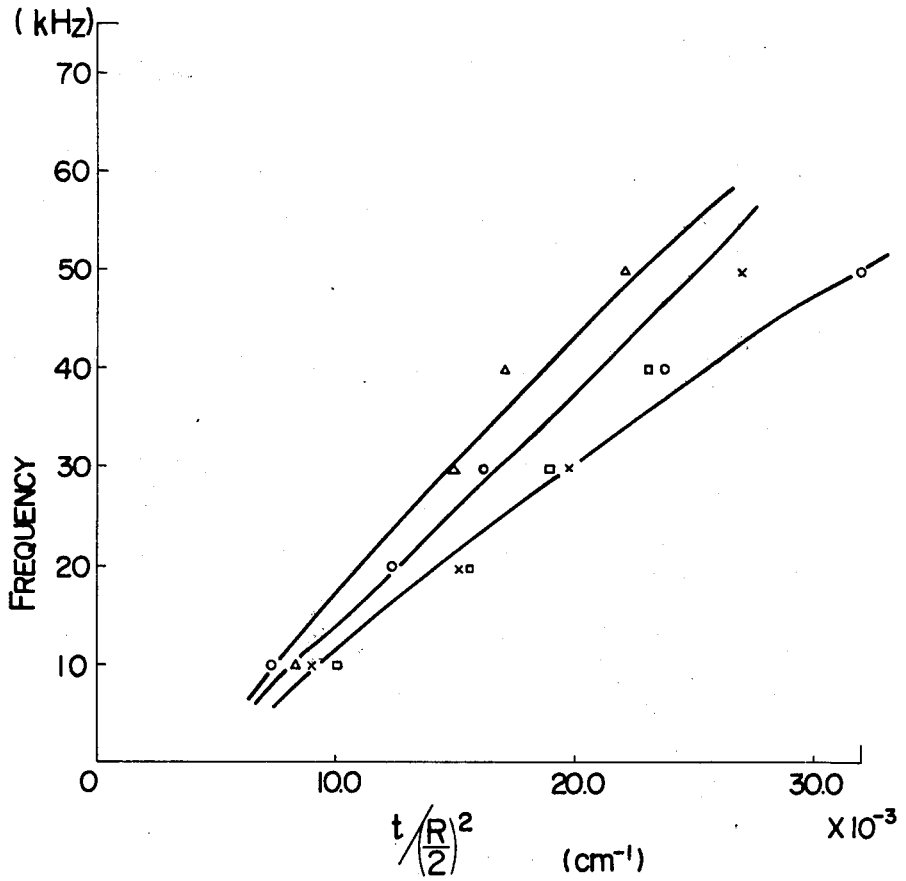

FIG. 16 is a graphic representation of FIG. 15.

The present invention will now be explained in detail. The microphone of the present invention is similar in construction to that shown in FIGS. 1 and 2 but is characterized in that it is operated near two or three adjacent resonance frequencies and in a frequency band covering those resonance frequencies, of a fundamental wave and respective order higher harmonics of the deflection vibration of a transducer.

The principle of operation is explained below. The fundamental frequency $f_{01}$ is given by:

$$f_{01} = \frac{0.4\,t}{(\frac{R}{2})^2}\sqrt{\frac{Q}{\rho(1-\sigma^2)}} \qquad (1)$$

where $t$: thickness of the metal plate
$\rho$: density of the metal plate
$R$: diameter of the metal plate
$\sigma$: Poison's ratio
$Q$: Young's modulus of the metal plate Actually, however, effective values should be used because an assembly of the metal plate and the piezoelectric plates has no uniform thickness in section and has no homogeneous material. The transducer has first, second and third harmonic vibration modes. Generally the transducer does not always have an infinite number of harmonic vibration modes but has one to four at most. For example, for a given thickness and diameter of the piezoelectric ceramic plates and a given thickness of the aluminum sandwiched thereby, only a fundamental wave is generated when the diameter of the aluminum plate is small, and as the diameter of the aluminum plate increases the fundamental wave attenuates and the second, third and fourth harmonics are generated. The frequencies of the harmonics are multiples of the frequency given by the equation (1) by the factor of the constants. Considering equation (1), in a bonded vibrator device, the resonance frequency thereof is approximately proportional to the thickness and inversely proportional to the square of the diameter, although it cannot be said that $Q$ and $\rho$ are not at all dependent on the diameters and thickness of the respective elements. On the other hand, in order to form a wide band microphone it is necessary to have a resonance frequency at $f_o$ + (10 to 15) kHz and $f_o$ − (10 to 15) kHz about a center frequency $f_o$ kHz. Again considering equation (1), it shows that it is possible to attain a resonance frequency which meets the above requirement by appropriate adjustment of $t$ and $R$. Experimental manufacture of the transducers (bonded vibrator devices) under various conditions showed that the resonance frequencies could be established, for example, at 30 kHz and 50 kHz when $f_o = 40$ kHz and at 40 kHz and 60 kHz when $f_o = 50$ kHz. As an example, FIG. 7 shows the change of the resonance frequency with respect to the diameter of the aluminum plate when the piezoelectric ceramic plates have diameter of 8.2 mm, and a thickness of 0.26 mm and the aluminum plate has a thickness of 0.1 mm. In FIG. 7, curve 19 is for a fundamental wave, curve 20 is for a first harmonic, curve 21 is for a second harmonic and curve 22 is for a third harmonic. In this case, it is seen that when the diameter is 16.5 mm, the resonance frequencies appear near 30 kHz and 50 kHz. The addmitance characteristic of the transducer is shown in FIG. 8, the receiving sensitivity characteristic of a microphone using the above transducer is shown in FIG. 9, and the transmission sound pressure characteristic is shown in FIG. 10. It is seen from those figures that the microphone has an operating frequency band of 20 kHz wide or more, which is three times as wide as that of the prior art microphone. In FIGS. 9 and 10, curves 23 show the characteristics in accordance with the present invention.

Figure 1:
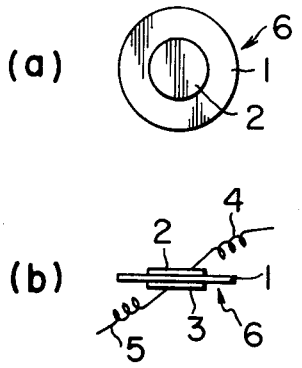
FIG. 1 PRIOR ART
Figure 2:
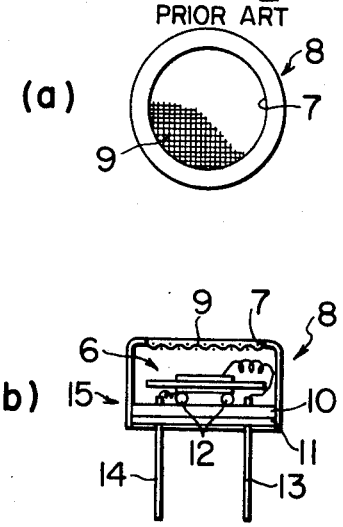
FIG. 2 PRIOR ART
Figure 3:
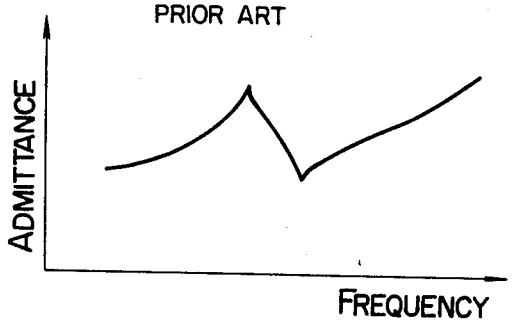
FIG. 3 PRIOR ART
FIG. 3 shows the admittance characteristic of a prior art microphone.
Figure 4:
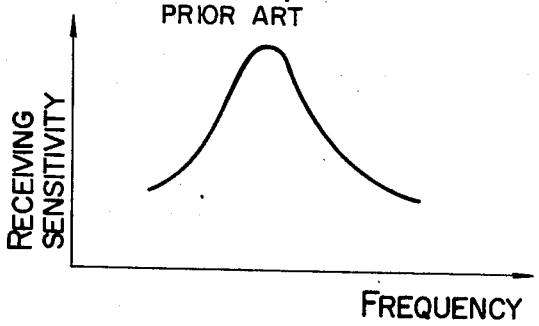
FIG. 4 PRIOR ART
FIG. 4 shows the reception characteristic of a prior art microphone.
Figure 11:
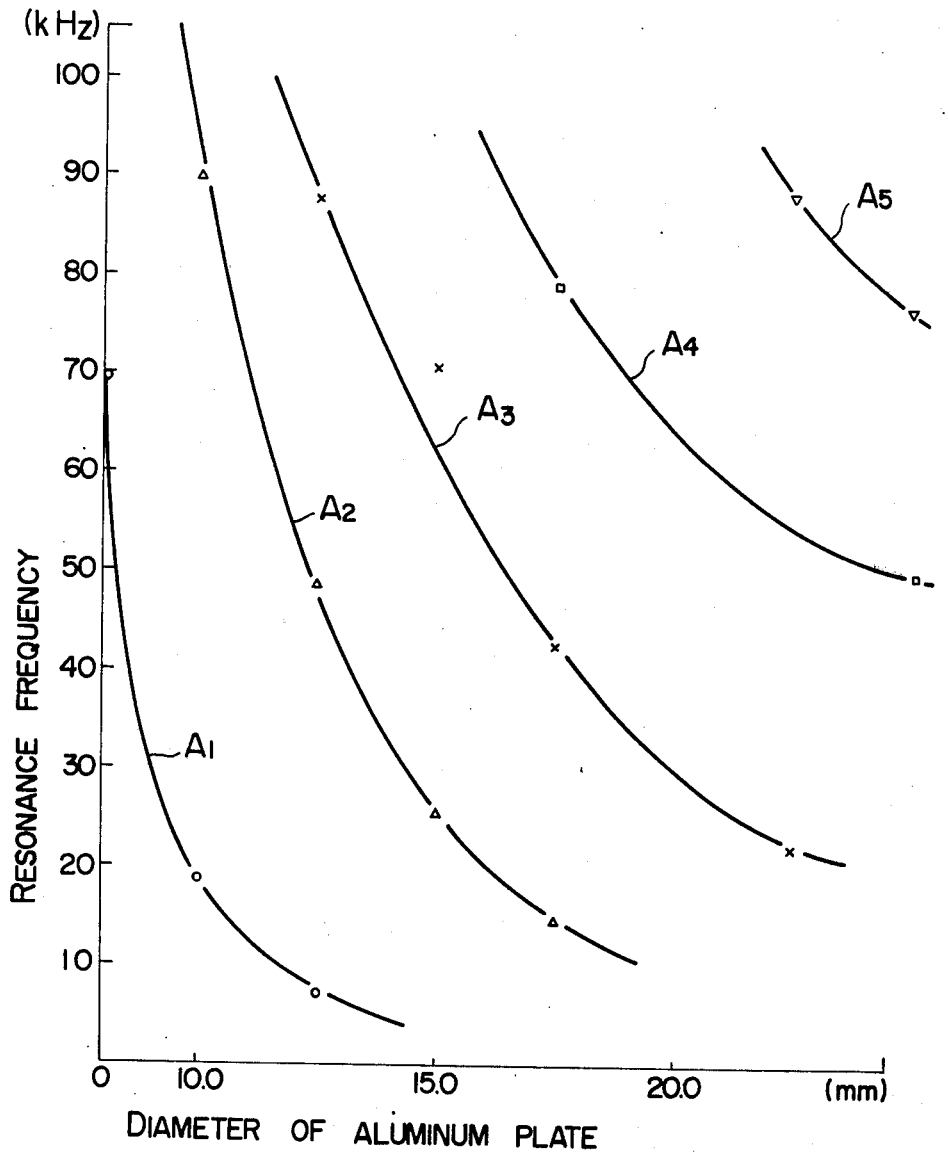
Figure 12:
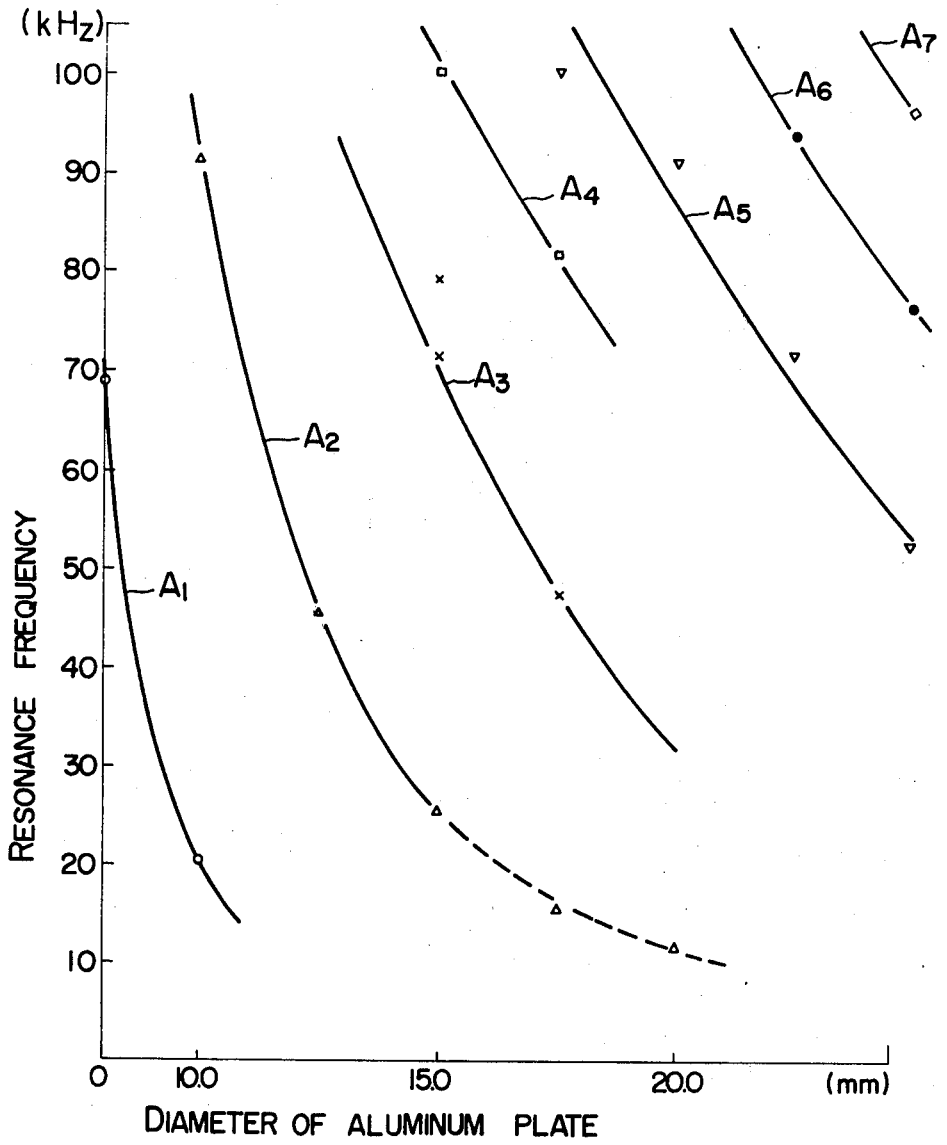
Figure 13:
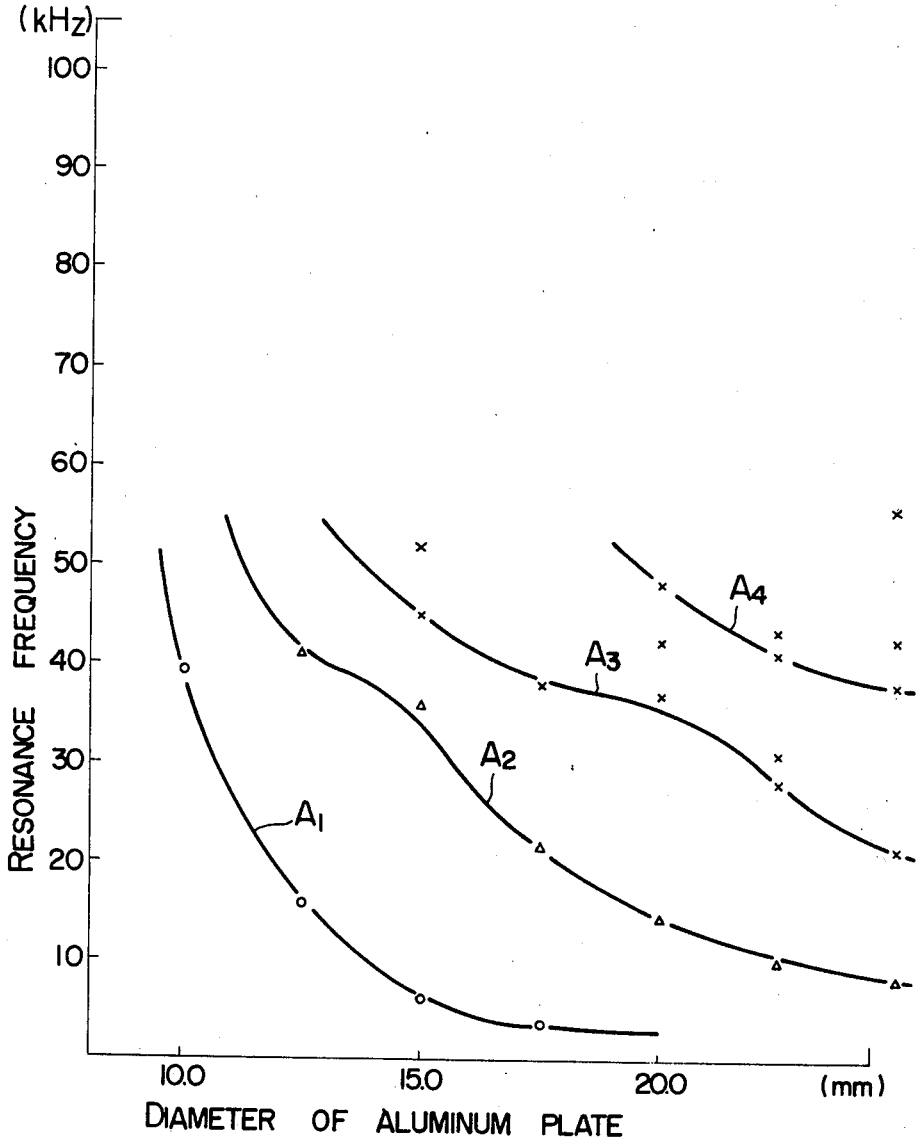
Figure 14:
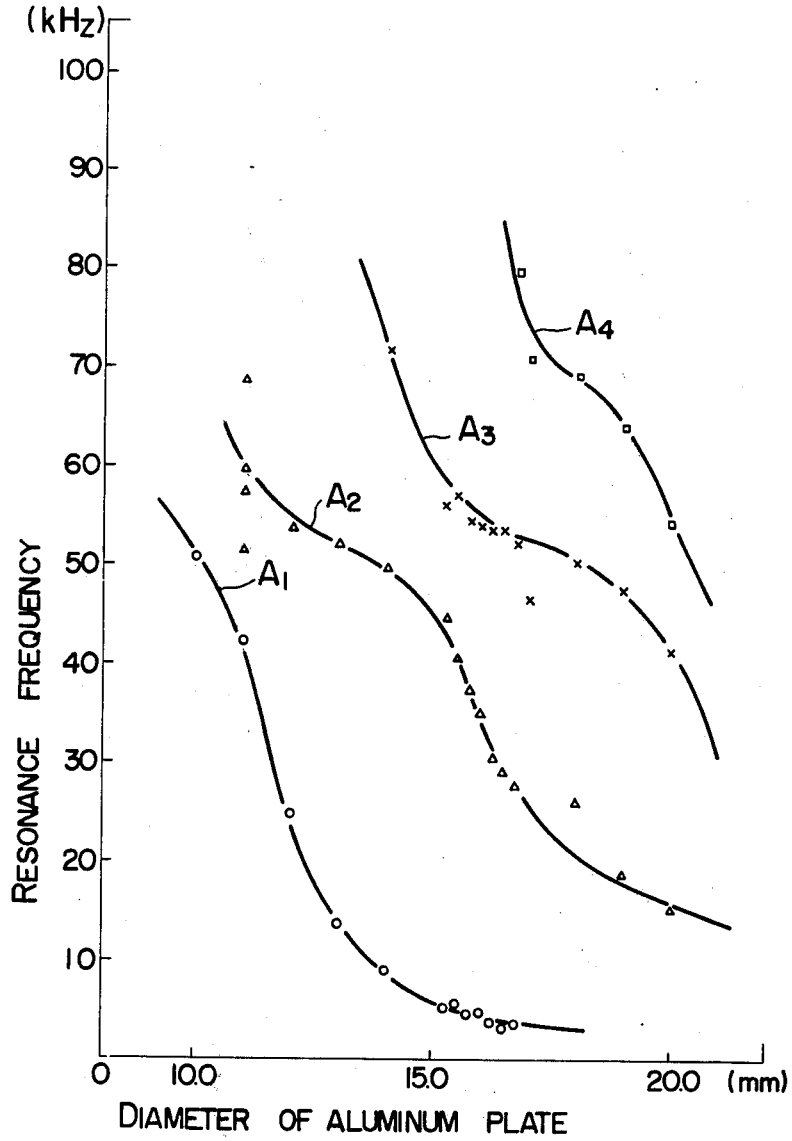

FIG. 11 shows the relationship between the diameter of the aluminum plate and the resonance frequencies for fundamental wave ($A_1$), first harmonic ($A_2$), second harmonic ($A_3$), third harmonic ($A_4$) and fourth harmonic ($A_5$), in an ultrasonic ceramic microphone having an aluminum plate of 0.1 mm thickness as the metal plate 1 shown in FIG. 1 and piezoelectric ceramic plates of 0.26 mm thickness and 6.0 mm diameter disposed on the upper and lower surfaces of the aluminum plate. FIGS. 12 to 14 show the relations of the diameter of the aluminum plate to the resonance frequencies for the fundamental wave ($A_1$), first harmonic ($A_2$), second harmonic ($A_3$), third harmonic ($A_4$), . . . ., in an ultrasonic ceramic microphone having an aluminum plate of 0.1 mm thickness and piezoelectric ceramic plates of 0.3 mm thickness and 6.0 mm diameter (FIG. 12), an ultrasonic ceramic microphone having an aluminum plate of 0.1 mm thickness and piezoelectric ceramic plates of 0.2 mm thickness and 8.2 mm diameter (FIG. 13), and an ultrasonic ceramic microphone having an aluminum plate of 0.1 mm thickness and piezoelectric ceramic plates of 0.30 thickness and 8.2 mm diameter (FIG. 14), respectively.

FIG. 15 summarizes FIGS. 11 to 14 showing the value of $$\frac{t}{(\frac{R}{2})^2}\ \mathrm{cm}^{-1},$$

where R is the diameter of the aluminum plate and t is the thickness thereof. FIG. 16 is a graphic representation of FIG. 15, in which a first harmonic appears near 30 kHz when the condition of $$15 \times 10^{-3} < \frac{t}{(\frac{R}{2})^2} < 20 \times 10^{-3}$$

is met and thus a wide band ultrasonic ceramic microphone can be provided.

As has been described in detail hereinabove, the present invention can provide a wide band microphone in a simple and easy way.

What is claimed is:

1. An ultrasonic ceramic microphone comprising an electro-acoustic transducer including a metal plate having a thickness $t$ and a diameter $R$ satisfying the relation $$7.3 \times 10^{-3}\ \mathrm{cm}^{-1} < \frac{t}{(\frac{R}{2})^2} < 31.9 \times 10^{-3}\ \mathrm{cm}^{-1},$$

and a pair of piezoelectric ceramic plates disposed on the upper and lower surfaces of said metal plate, the diameters of said piezoelectric ceramic plates being less than the diameter of said metal plate, said ultrasonic ceramic microphone being operable in an operating frequency band including the fundamental frequency of the deflection vibration of said electro-acoustic transducer and at least two higher harmonics of said fundamental.

2. An ultrasonic ceramic microphone according to claim 1, wherein said metal plate is made of aluminum.

3. An ultrasonic ceramic microphone according to claim 2 wherein said aluminum metal plate has a thickness and a diameter satisfying the relation $$15 \times 10^{-3}\ \mathrm{cm}^{-1} < \frac{t}{(\frac{R}{2})^2} < 20 \times 10^{-3}\ \mathrm{cm}^{-1}$$

4. An ultrasonic ceramic microphone according to claim 1, which further includes a terminal board supporting said electro-acoustic transducer, and a casing housing said terminal board, said casing having an open end on one side thereof.

* * * * *